United States Patent [19]

Fredrixon

[11] Patent Number: 4,599,871

[45] Date of Patent: Jul. 15, 1986

[54] STORAGE PLANT

[76] Inventor: Benny Fredrixon, Hersbyvägen 58, Lidingö, S-181 42, Sweden

[21] Appl. No.: 711,510

[22] PCT Filed: Jun. 28, 1984

[86] PCT No.: PCT/SE84/00247

§ 371 Date: Feb. 13, 1985

§ 102(e) Date: Feb. 13, 1985

[87] PCT Pub. No.: WO85/00422

PCT Pub. Date: Jan. 31, 1985

[30] Foreign Application Priority Data

Jan. 7, 1983 [SE] Sweden ..... 8303794

[51] Int. Cl.[4] ..... F25D 25/00

[52] U.S. Cl. ..... 62/378; 62/441

[58] Field of Search ..... 62/378, 441, 62, 458

[56] References Cited

U.S. PATENT DOCUMENTS

| | | | |
|---|---|---|---|
| 602,239 | 4/1898 | De Palacio . | |
| 842,595 | 1/1907 | Vasconcelles . | |
| 911,879 | 2/1909 | Jackson . | |
| 976,619 | 11/1910 | Barker . | |
| 1,056,885 | 3/1913 | Chase . | |
| 1,199,819 | 10/1916 | Phillips . | |
| 1,484,171 | 2/1924 | Carstens . | |
| 3,699,780 | 10/1972 | Gehrmann | 62/378 |
| 3,955,376 | 5/1976 | Mekenitsky et al. | 62/378 X |
| 3,972,204 | 8/1976 | Sidorenko et al. | 62/447 |
| 3,982,407 | 9/1976 | Guenette | 62/441 |
| 4,063,432 | 12/1977 | Chaussy et al. | 62/441 X |
| 4,345,443 | 8/1982 | Yamashita | 62/441 X |

FOREIGN PATENT DOCUMENTS

| | | |
|---|---|---|
| 184048 | 5/1963 | Sweden . |
| 350563 | 1/1969 | Sweden . |
| 632545 | 11/1949 | United Kingdom . |

*Primary Examiner*—Lloyd L. King

*Attorney, Agent, or Firm*—Shapiro and Shapiro

[57] ABSTRACT

A plant for storage of goods intended to be stored at different temperature levels, especially freeze storage and cold storage, includes storage compartments adapted for vertical insertion and removal of pre-loaded containers apparatus and handling permitting such vertical movement of the containers. One or more storage compartments (8), which can be opened upwards and are intended for goods having a storage temperature substantially different from the ambient temperature, are arranged inside one or more compartments constituting a climatic barrier and suitably formed as upwardly openable storage compartments (9) for goods having a storage temperature less different from the ambient temperature. A part (1) of a building or the like containing the storage compartments is especially adapted to be surrounded on all sides by a medium having a temperature which remains substantially constant independently of the times of the year and like variations.

9 Claims, 7 Drawing Figures

STORAGE PLANT

The present invention relates to a plant for storage of goods to be stored at different temperature levels, especially freeze storage and cold storage, including storage compartments adapted to receive previously loaded containers, to and from which compartments the containers are conveyed by means of a handling unit permitting vertical movement.

Conventional freeze houses usually consist of a thoroughly insulated hall building in which there are arranged rows of shelf-like stands or racks separated by aisles. To obtain the required space for the operation of handling tools or vehicles it is often necessary to have longitudinally and transversely extending aisles. In prior art freeze houses it is possible to utilize only about 60% of the floor area for storage while the rest is transport and handling areas.

For optimum utilization of the freeze house volume use is made of very high stands which, however, often makes it necessary to increase the aisle width due to the fact that the handling tools or vehicles must be broad to provide the required stability. Such constraints not applicable to track-bound handling means which bear on rails on the stands.

In conventional freeze houses the air change rate is high, a principal reason for this being that cold air will leak out and be replaced every time doors or the like are opened.

From the point of view of staff welfare, conventional freeze houses are troublesome since the staff must all the time stay in a temperature which generally is about −30°C. This involves a risk of frost injuries even if protective clothing is used.

If freeze house halls of today's design are to function as planned also during summer days it is necessary to provide extensive insulation. During the major part of the year considerably less insulation would be sufficient but the insulation must be dimensioned to cover the most unfavourable case.

To eliminate the risk of frost-formation with the accompanying risk of ground movements the freeze house floors must be insulated very thoroughly underneath. To reduce the ground insulation, as suggested in the normal case, and lay in frost-preventing heating coils which obviously increase the total energy consumption can hardly be considered a rational solution of this problem.

A factor causing problems in calculating and constructing freeze house walls in the high temperature difference between the outside air and the interior of the freeze house. In hot summer days this difference may amount of more than 60° while in winter it may vary between 10° and 30° . This problem may be solved by allowing the maximum outside temperature to be decisive for dimensioning, and by basing the insulation capacity on the resulting temperature difference. It is also possible to slighly reduce the insulation capacity and instead give the freeze machines sufficient overcapacity or, alternatively, double the number of freezing machines so that these, when necessary, can supply such a sufficient amount of cold air that the lack of insulating capacity will be compensated.

The object of this invention is to provide a storage plant, especially for freeze storage, while eliminating the inconveniences entailed with conventional freeze houses.

A principal characteristic of the storage plant according to the invention is that one or more storage compartments, which can be opened upwards and which are intended for good having a storage temperature substantially from the ambient temperature, are arranged inside one or more additional compartments. The latter constitute a climatic barrier and suitably are designed as upwardly openable storage compartments for goods having a storage temperature which is less different from the ambient temperature. A part of a building or the like, containing the storage compartments, is especially adapted to be surrounded on all sides by a medium having a temperature which is approximately constant independently of the various seasons and the like.

Great advantages concerning energy are gained by arranging the plant for vertical displacement of storage goods down into and up from the storage compartment and by positioning the storage compartment under the handling area. Introduction and lifting out of goods thus do not cause any cold-air leakage. As the storage compartment for deep-frozen goods is surrounded by a storage compartment for cold-stored goods, there are obtained temperature differences that are favorable from the point of view of insulation design. In particular, the temperature difference between the freezing compartment and the cooling compartment and, between the cooling compartment and the exterior environment will result in reduced insulation costs. As the building section containing the freezing and cooling compartments is submerged in the ground or, in an alternative embodiment, in water, insulation design maybe based on a substantially constant outside temperature and this will have a favorable influence on the insulation cost as well as on the need of over-capacity of the freezing and cooling units.

The overlying handling compartment may be of a comparatively simple design with low demands for insulating capacity in walls and ceiling since the goods will only momentarily be situated therein. In the handling compartment the temperature need not be substantially lower than normal room air temperature, which means that the staff need not use protective clothing.

Calculations made on the basis of climatic conditions corresponding to those prevailing in the Middle East and an imagined storing capacity amounting to 1016 tons indicate a reduction of 40% as concerns the building area and 60% as concerns the building volume. The most obvious reduction, however, concerns the required energy where, with the same storing capacity, a saving of no less than 85% is gained.

The background of these favorable figures is, int. alia, as follows.

As it is not necessary to provide the freezing and cooling compartments with transport and aisle doors on floor level, the energy loss of 40–50% and 20–25% respectively, which would otherwise occur, is saved.

As no staff people will stay in the freezing and cooling compartments no lighting is required therein. Lighting fittings in conventional storage plants generate heat—93% of electric energy supplied to a lighting fitting is converted into heat—and this heat addition must be eliminated by energy supply to the freezing and cooling units.

In the freezing and cooling compartments of a plant according to the invention, temperature and air movements are under complete control and the risk of uncontrolled air movements is entirely eliminated. This means that it is possible to offer a better control of the storage area and thus obtain a higher product quality than in case of conventional plants where the air temperature always varies due to uncontrollable air movements caused by opening of doors and the like and where fresh supply of cold air from the outside—with the accompanying condensation and frost formation problems—must take place constantly.

Contributory to the favorable figures as regards saving of energy is of course the fact that "waste" from the freezing section can be utilized in the cooling section of the plant and reduce the energy demand there.

Other characteristics and advantages of the plant according to the invention will appear from the following description.

Exemplary storage plants according to the invention will be described more fully below with reference to the accompanying drawings, in which.

Figure 2:
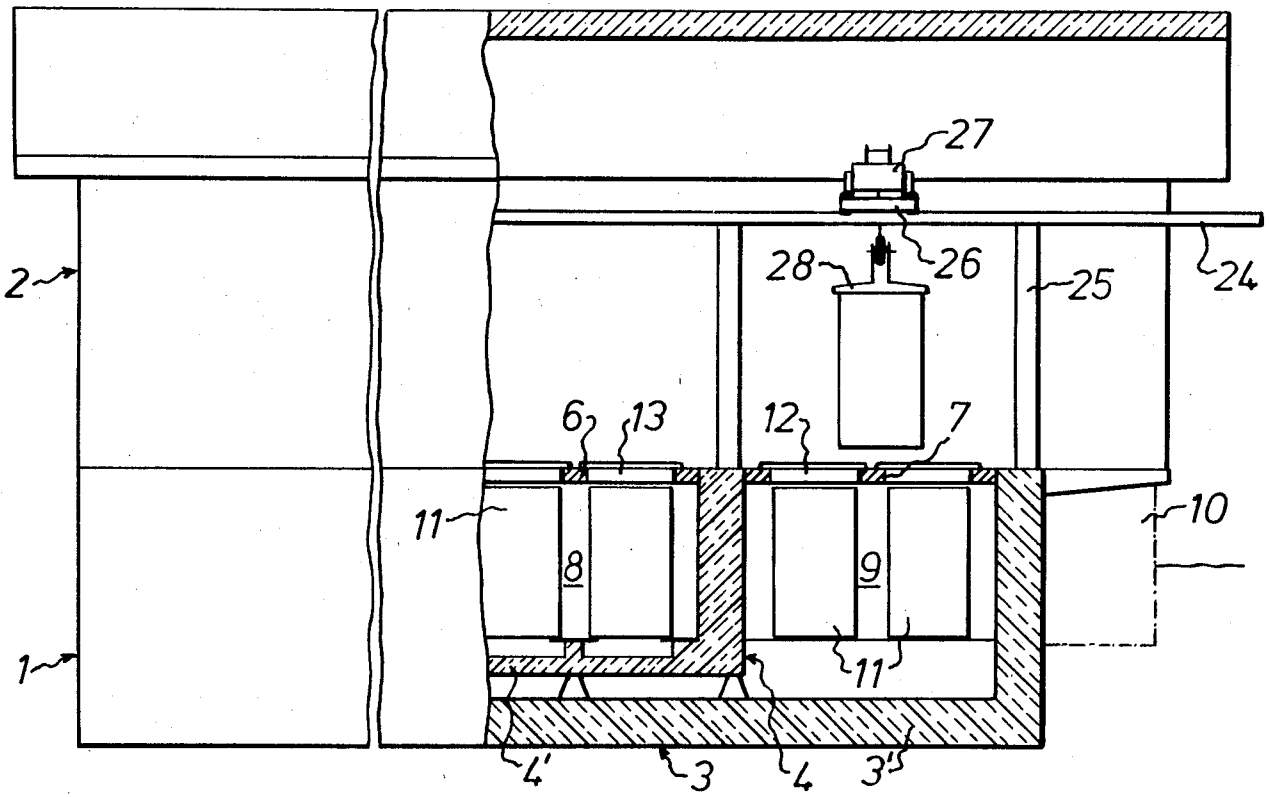
FIG. 2 is a partically sectional side view of the same plant.
Figure 3:
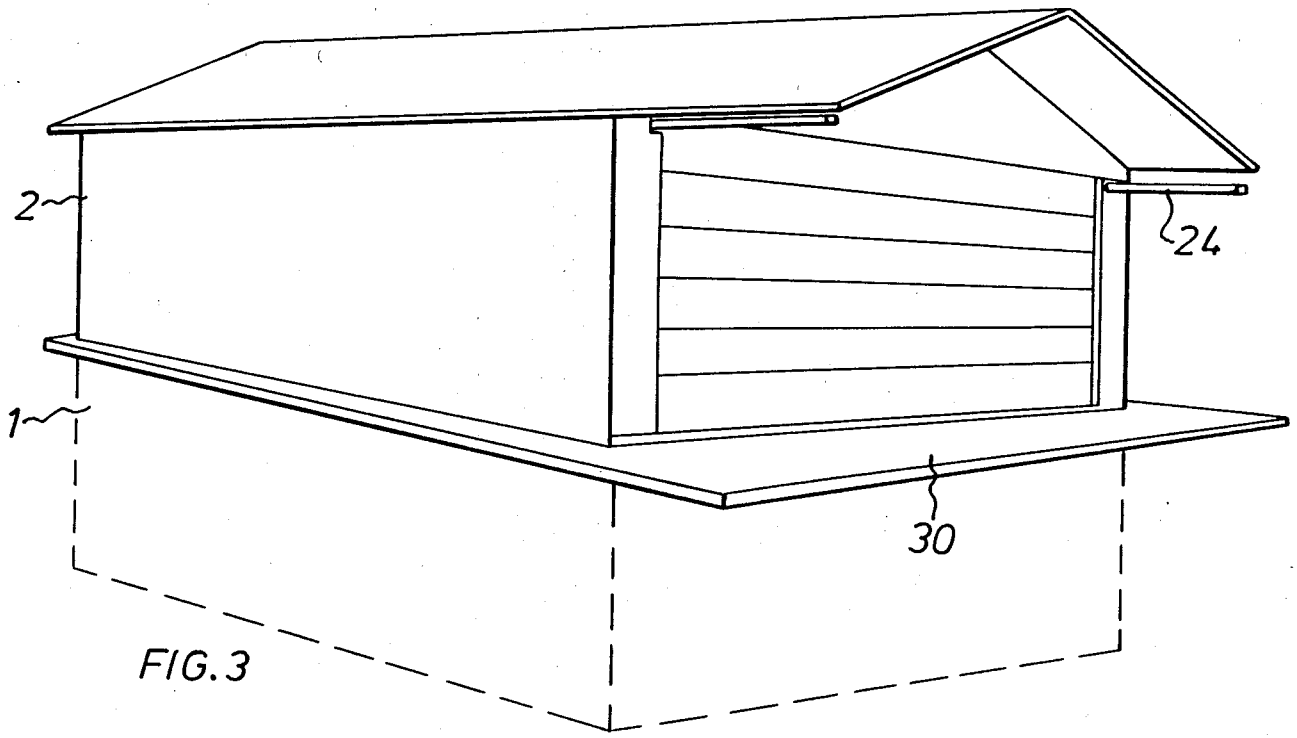
FIG. 3 is a schematic perspective view of a ground-based embodiment of a plant according to the invention.

As shown in FIG. 2, a plant according to the invention includes a sub-structure 1 and a superstructure 2.

Figure 1:
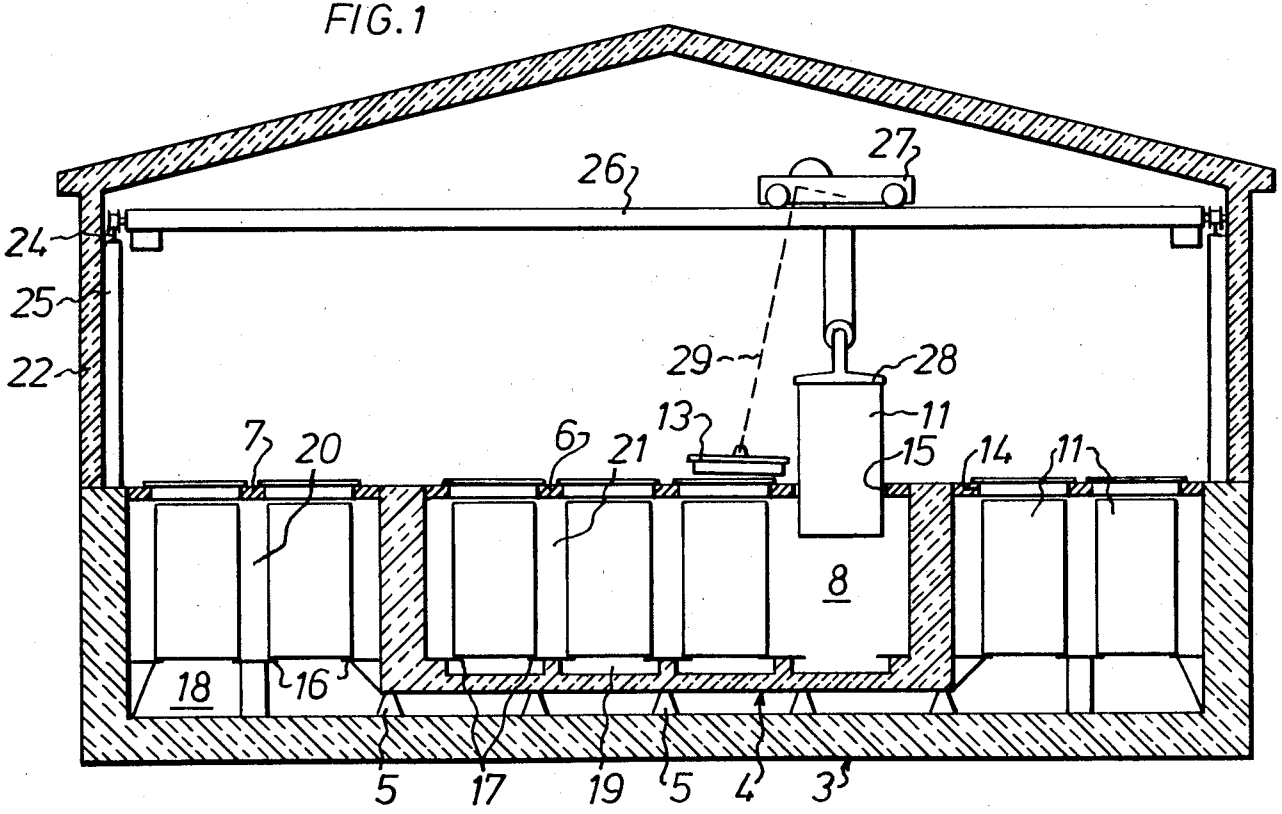
FIG. 1 is a cross-section of a schematically illustrated plant according to the invention.

The sub-structure, as will also be seen in FIG. 1, is constructed in the form of an outer box-shaped part 3 with an inner box-shaped part 4 arranged therein. Walls and bottom of both the outer part and the inner part 3 and 4, respectively, are made of resistant heat-insulating material. The inner box-boxed shaped part is supported by columns or feet 5 so that its bottom 3' is spaced from the bottom 4 of the outer part. Alternatively it is possible to utilize a concrete layer which is insulated from the bottom of the part 3 and has a large number of horizontal channels passing therethrough. The upwardly facing opening of the inner part 4 is crossed by beams or the like 6 so that the opening will be divided up into a number of smaller openings, 15 and in the same way the upwardly facing opening of the outer part 3, which opening surrounds that of the inner part, is crossed by beams 7 to yield smaller openings 14.

The compartment 8 in the inner part is designed for freeze storage of goods while the compartment 9, which also serves as a climatic barrier, is designed for cold storage of goods.

The compartments 8 and 9 have separate cooling and freezing units which may be placed in the compartment designed by 10 or be allowed to occupy part of the respective compartments 8 and 9.

The freezing and cooling compartment 8 and 9 are adapted to receive a large number of containers 11 which are carried down through the openings 14 and 15 normally covered by doors 12, 13 and rest on supports 16 and 17 respectively, e.g. perforated metal sheets, so designed that air passages 18 and 19 respectively are formed under the containers. Vertical air passages 20 and 21 are also provided between the containers. The freezing air and the cooling air are introduced at the bottom and allowed to circulate under and around the containers which should be of an air-permeable type.

The super-structure 2 consists of a hall building having moderately insulated walls 22 and a roof 23. Arranged along the long sides of the hall are overhead rails 24 supported by columns 25 and running thereon is an overhead beam 26 along which an overhead travelling carriage or crane 27 is movable. The travelling carriage carries a lifting yoke 28 provided with quick locking means adapted to co-operate with complementary quick locking means in the containers 11. The travelling carriage can also carry a bow 29, indicated by dashed lines in FIG. 1, with coupling means for lifting and swinging away the doors 12, 13, while lifting and inserting containers 11.

Only people handling the travelling crane need stay in the hall building. It is also possible to utilize remote control of the travelling crane or electronic control of the crane by means of a computer which, on the basis of a command fed into it and stored data regarding goods situated in the compartments, can insert or take out a desired container on order. Containers may be collected from and left to other transport means at a loading bridge, designated by 30, or maybe directly received from or placed on the platform of a vehicle.

Figure 4:
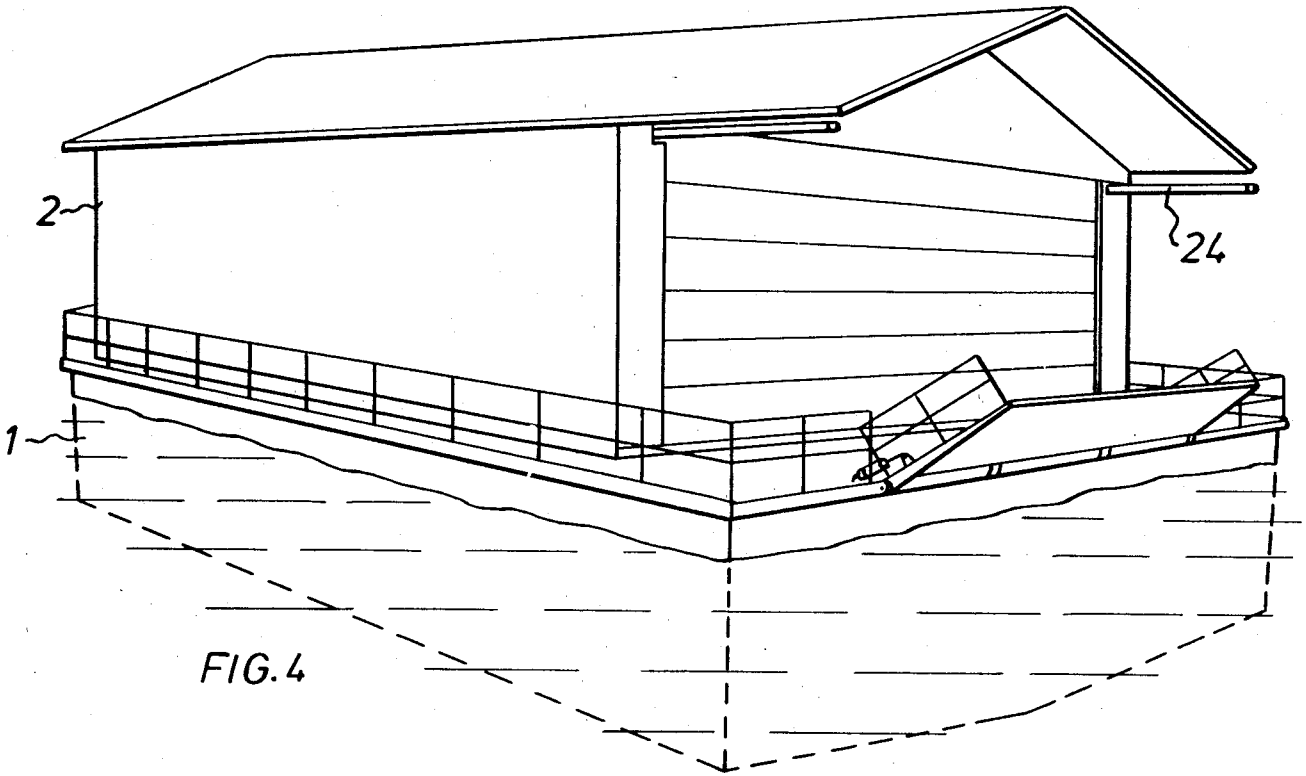
FIG. 4 is a corresponding view of a floating plant according to the invention.

The invention may be varied in several ways without departing from the inventive concept. In addition to the fact that the plant, as has already been mentioned and is shown in the drawings, can be placed on or, more exactly, be submerged in the ground, it may be made floating, as appears from FIG. 4. This embodiment is especially applicable to season-bound use when the plant can be moved, if required.

Figure 5:
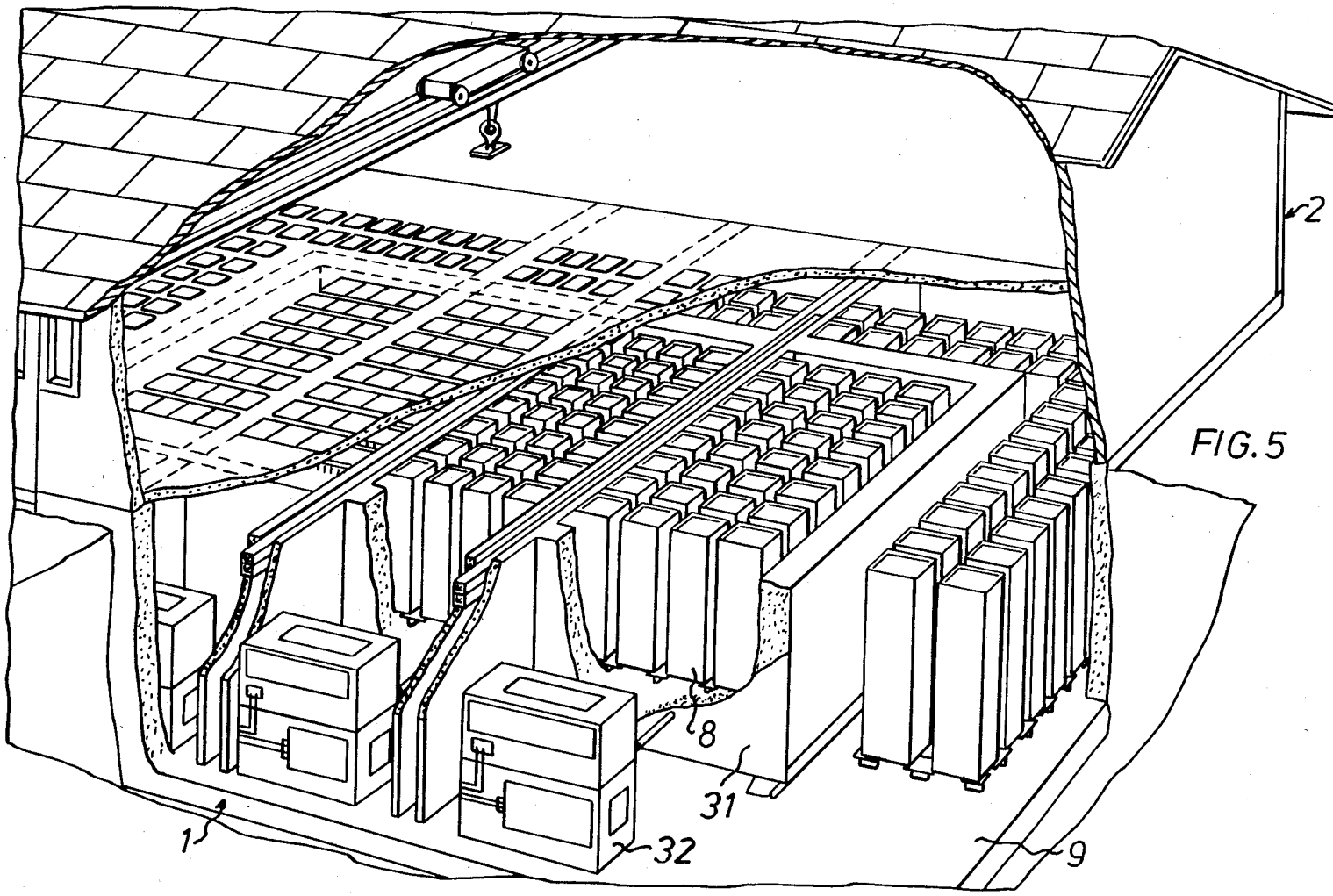
FIG. 5 is a partially cut-out perspective view of a preferred embodiment of such a plant.

According to one preferred embodiment shown in FIG. 5, the storage section of the plant is constructed of a number of preferably prefabricated cassette-like units 31 which can be placed in a relatively simple outer shell built in situ. It is also possible to use a prefabricated outer shell. In the illustrated embodiment only the compartments 8, i.e. the freeze storage compartments, are formed of cassette-like units 31 while the cold storage compartments 9, constituting the so-called climatic barrier, are situated around said units inside the outer shell 3 provided with an appropriate insulation. Also the compartments 9, however, can be formed of units similar to cassette units, thus gaining the advantage that the storage plant will be more flexible. In that case cassette units 31 can be utilized, as required, for freeze or cold storage by appropriate control of the freezing and cooling units. This flexibility is especially valuable in areas where the needs of freeze and cold storage are variable dependent on the season.

To simplify construction and maintenance, the freezing and cooling systems 32 should be disposed in units which are easy to disassemble so that they can be moved as required. For reasons of reliability in operation several units should be used so that, if a separate unit is out of order, it will still be possible to maintain the required freezing effect.

Figure 6:
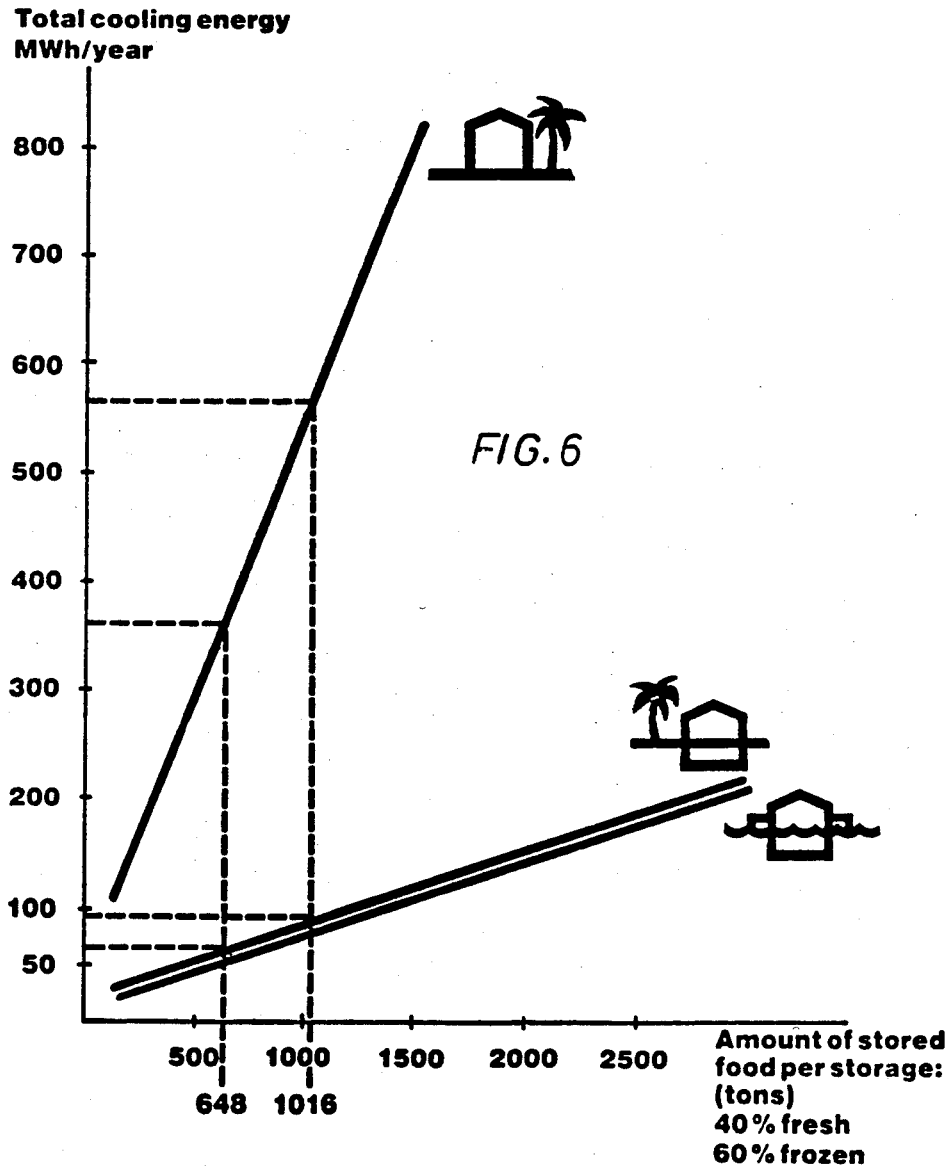
FIG. 6 shows a diagram illustrating the energy consumption in plants arranged according to the invention as compared to the energy consumption in conventional plants with corresponding storing capacity.

The diagram shown in FIG. 6 illustrates the energy demand in plants having a corresponding storing capacity and designed so that 40% of the plant is utilized for cold storage while 60% is utilized for freeze storage.

The invention permits storing deep-frozen goods as well as goods to be cold-stored, at a substantially reduced energy cost within a substantially reduced storage volume.

Figure 7:
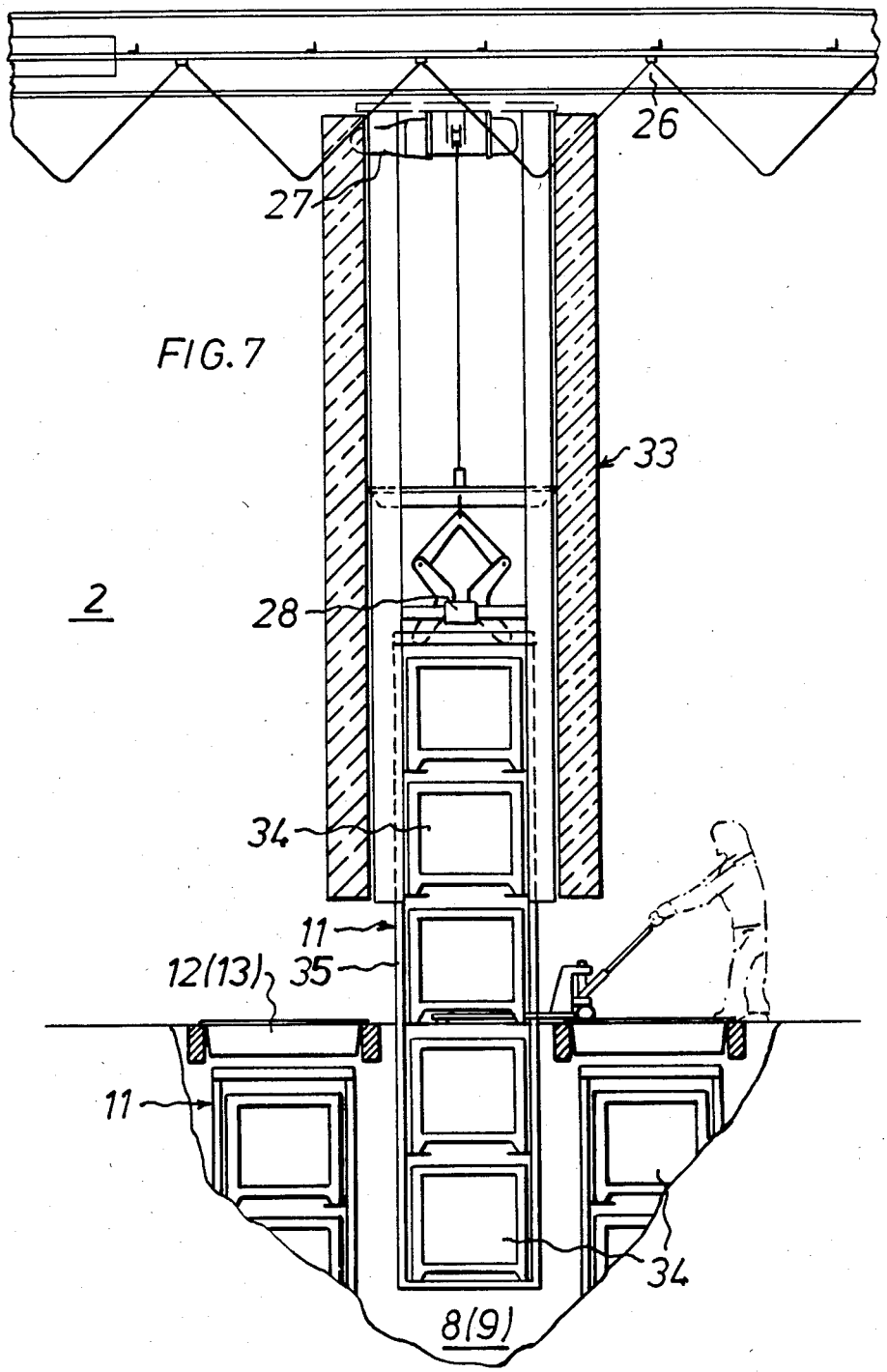
FIG. 7 shows schematically a preferred embodiment of the handling unit.

In a preferred embodiment of the handling apparatus, shown in FIG. 7, the overhead travelling carriage 27 running on the overhead beam 26, which in turn can be moved along the overhead rails 24, is provided with rigidly arranged guide equipment 33. Guide 33 comprises an inner structure provided with guide rolls or the like and insulation arranged around said structure. The insulated guide extends down toward the floor in the hall building to such an extent that a free space is left beneath the guide with a height slightly exceeding the height of a load carrier, a load pallet or the like 34. In this embodiment the containers 11 consist of frame structures 35 provided with abutments to support a number of load carriers 34. By the use of a handling apparatus similar to that of FIG. 7 an advantage is achieved in that only one load carrier at a time is exposed to the air in the hall building. Some of the load carriers supported by the frame structure 35 are still situated in the freeze compartment and some are still in the inner part of the insulated guide equipment. Only one load carrier stands free, i.e. the one to be taken out from or inserted in the frame structure. The load carriers and consequently the good will thereby be exposed to the air as little as possible, which improves the storing quality.

The invention must not be considered restricted to that described above and shown in the drawings but may be modified in various ways within the scope of the appended claims.

I claim:

1. A plant for storage of goods intended to be stored at different temperature levels, especially frozen storage and cold storage levels, including storage compartment means adapted for vertical insertion and removal of pre-loaded container, and handling apparatus for effecting said insertion and removal, characterized in that a sub-structure of said plant includes first storage compartment means for storing goods at a first temperature substantially different from ambient temperature and second storage compartment means surrounding said first storage compartment means for storing goods at a second temperature less different than said first temperature from the ambient temperature and for providing a climatic barrier about said first storage compartment means, in that bottom means of said first storage compartment means is thermally insulated from a bottom of said sub-structure, and in that said sub-substructure is constructed to be disposed within a surrounding medium having a temperature which remains substantially constant year-round.

2. A plant as claimed in claim 1, characterized in that said sub-structure is constructed to be suitable below the ground level.

3. A plant as claimed in claim 1, characterized in that said sub-structure is constructed to be at least partly situated below a water level.

4. A plant as claimed in claim 1, characterized in that arranged above the sub-structure is a hall-like superstructure provided with doors or the like.

5. A plant as claimed in claim 4, characterized in that arranged in the super-structure is at least one overhead travelling crane means for permitting vertical and horizontal transport of storage containers.

6. A plant as claimed in claim 1, characterized in that the respective compartment means are constructed to receive a large number of containers and that the respective comparment means include covers which can be individually opened to uncover a corresponding space for a container.

7. A plant as claimed in claim 5, characterized in that arranged in the respective storage compartment means are abutments positioned to provide air passages under and along the sides of compartment portions which receive containers.

8. A plant as claimed in claim 1, characterized in that the first and second storage compartment means are bonded by respective bottom and side walls and in that the bottom wall of the first compartment means is supported above the bottom wall of the second compartment means by thermal-bridge preventing means.

9. A plant as claimed in claim 1, characterized in that the handling apparatus includes an insulated guide attached to an overhead carriage and extending downwards from the overhead carriage towards the first and second storage comparment means, said guide being spaced above the respective .storage compartment means at a height substantially corresponding to the height of a load carrier for stored goods.

* * * * *

UNITED STATES PATENT AND TRADEMARK OFFICE

CERTIFICATE OF CORRECTION

PATENT NO. : 4,599,871

DATED : July 15, 1986

INVENTOR(S) : Benny Fredrixon

It is certified that error appears in the above-identified patent and that said Letters Patent are hereby corrected as shown below:

On the cover page of the patent, item [30], "Jan. 7, 1983" should be --July 1, 1983--.

Signed and Sealed this

Fourth Day of November, 1986

[SEAL]

*Attest:*

DONALD J. QUIGG

*Attesting Officer*

*Commissioner of Patents and Trademarks*